US006842112B2

(12) United States Patent
Pulis et al.

(10) Patent No.: US 6,842,112 B2
(45) Date of Patent: Jan. 11, 2005

(54) BARRIER MOVEMENT POSITION SENSING

(75) Inventors: Derek Pulis, Port Jefferson Station, NY (US); Andrew Gavel, Huntington Bay, NY (US); William Chen, Elmhurst, NY (US)

(73) Assignee: The Chamberlain Group, Inc., Elmhurst, IL (US)

( * ) Notice: Subject to any disclaimer, the term of this patent is extended or adjusted under 35 U.S.C. 154(b) by 91 days.

(21) Appl. No.: 10/329,819

(22) Filed: Dec. 26, 2002

(65) Prior Publication Data

US 2004/0124992 A1 Jul. 1, 2004

(51) Int. Cl.[7] ..... G08B 13/08

(52) U.S. Cl. ..... 340/524; 340/545.4; 340/686.1; 340/545.1; 318/264; 318/466; 42/13

(58) Field of Search ..... 340/524, 545.1–545.9, 340/686.1–686.6; 318/264–266, 466–470; 49/13, 14

(56) References Cited

U.S. PATENT DOCUMENTS

| | | | | | |
|---|---|---|---|---|---|
| 4,408,146 | A | * | 10/1983 | Beckerman | 318/264 |
| 4,533,905 | A | * | 8/1985 | Leivenzon et al. | 340/524 |
| 5,218,282 | A | * | 6/1993 | Duhame | 318/603 |
| 6,288,511 | B2 | * | 9/2001 | Porter et al. | 318/466 |
| RE37,784 | E | * | 7/2002 | Fitzgibbon et al. | 318/466 |
| 6,605,910 | B2 | * | 8/2003 | Mullet et al. | 318/264 |

* cited by examiner

*Primary Examiner*—Jeffery Hofsass
*Assistant Examiner*—Anne V. Lai
(74) *Attorney, Agent, or Firm*—Fitch, Even, Tabin & Flannery

(57) ABSTRACT

Methods and apparatus for sensing barrier position in a barrier movement system are disclosed. Electrical apparatus is connected to the barrier and generates a barrier position signal representative of barrier positions which may be used by a controller to detect barrier position. The electrical apparatus can be manually adjusted to reflect a first barrier position such as a closed position. Other barrier positions can be sensed by comparing the barrier position signal to other manually adjustable position signals.

22 Claims, 6 Drawing Sheets

BARRIER MOVEMENT POSITION SENSING

The present invention relates to barrier movement systems and particularly to methods and apparatus for detecting barrier position in such systems.

Automatic barrier movement systems are known and used today which responds to various input stimuli to open and close a barrier. Modern automatic garage door openers or gate controllers are examples of automatic barrier movement systems. Known barrier movement systems generally include an electric motor controlled by a control circuit to move the barrier in response to user interaction. In order to safely and efficiently move the barrier, sensing apparatus is desirable to identify the position of the barrier during movement and when responding to user commands to begin such movement. As a part of barrier position detection, it is also desirable to know when the barrier is closed and when it is opened as opposed to being in an intermediate position.

Open and closed limit switches may be physically placed to be contacted in the event that the barrier has reached these two positions. Alternatively, a device may be used which is connected to the motor which moves the barrier and which moves proportionally to barrier movement between open and closed positions. The actual movement of such a device may be sufficiently reduced so that it can be mounted inside a housing of the barrier movement system, somewhat removed from the barrier itself.

SUMMARY

In accordance with the embodiments described herein a barrier position sensor includes a first potentiometer which changes an electrical resistance as the barrier moves. The first potentiometer is capable of manual adjustment when the barrier is in a first position. A voltage taken from the potentiometer can then be compared to a fixed reference to detect the presence of the door at the first position. The position sensing arrangement may also include a second potentiometer which is manually adjusted when the barrier is in a second position. By surveying voltages from the first and second potentiometers the second position of the door can be identified.

In accordance with an embodiment the barrier is first moved to a closed position and the first potentiometer is manually adjusted so that a voltage from the first potentiometer has a first predetermined relationship to a first reference voltage. The barrier may then be moved to an open position and a second potentiometer adjusted until a voltage from the second potentiometer bears a second predetermined relationship to the voltage from the first potentiometer. Thereafter a controller can identify when the barrier is in the open and closed positions by responding to the potentiometer voltage.

A potentiometer for use in the position sensing apparatus and method may include a portion frictionally coupled to a rotating member representing a position of the door. The frictional coupling is sufficient to control the potentiometer until a limit of travel of the potentiometer is reached at which event the coupling between the rotating member and the potentiometer slips. Further, the potentiometer includes a manually adjustable part so that the frictional coupling to the barrier movement can be overcome during set up and adjustments.

DESCRIPTION

Figure 1:
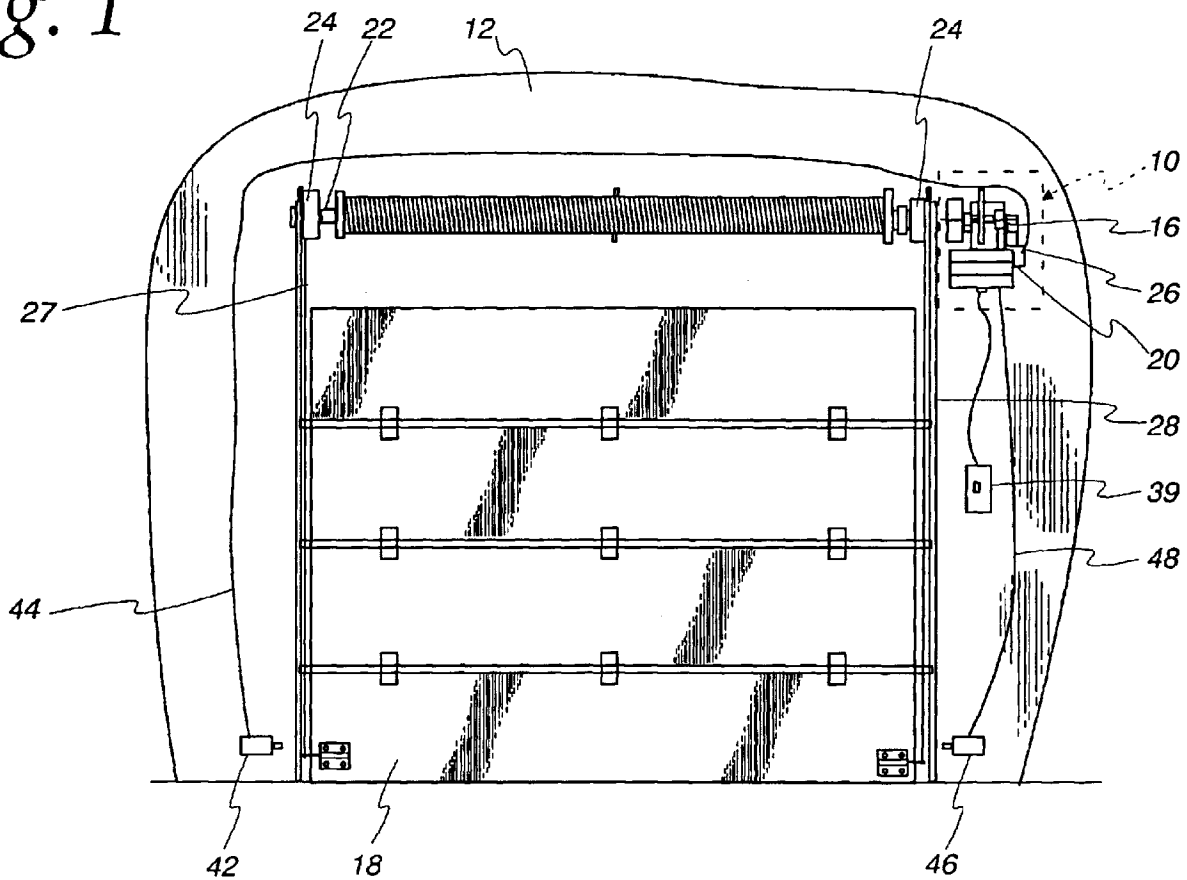
FIG. 1 represents a jack shaft barrier movement apparatus.

FIG. 1 shows a jack shaft garage door opener employing an embodiment of the barrier position indicator system. A multi-panel garage door 18 is raised and lowered to cover an opening in wall 12 by a motor assembly 10 acting through a jack shaft with spring assembly 22 having a pair of cable drums 24. The door moves on a guide track 28. A cable 27 which is attached to drums 24 the bottom of door 18 is played out and taken up by rotation of jack shaft 22. Motor assembly 10 includes an electric motor 14, a controller 84 and various input and output assembles as shown in FIG. 2.

Controller 84 is connected to receive user generated command signals from a wall control 39 or from a user remote control (not shown) via an antenna 32 and RF receiver 80. The user generated command signals generally to initiate an action on the part of the barrier movement system. When such action is taken, the controller 84 should do so with safety, efficiency and accuracy. Several sensing arrangements are employed to assist the controller in properly responding to user commands. Block 90 of FIG. 2 represent infrared sensors 42 and 46 which "watch" across the door opening and report possible obstructions the door movement to controller 84 via communication paths 44 and 48 respectively. A tachometer 110 senses the rotation speed of barrier moving motor 14 and reports that speed to controller 84 via a communication path 112. When lights 81 are to be illuminated or the motor is to be enabled to move the barrier open or closed control signals are sent via a path 102 from controller 84 to a control relay circuit 104 which includes a light control relay 41 and motor control relays 43 in the present embodiment.

Figure 2:
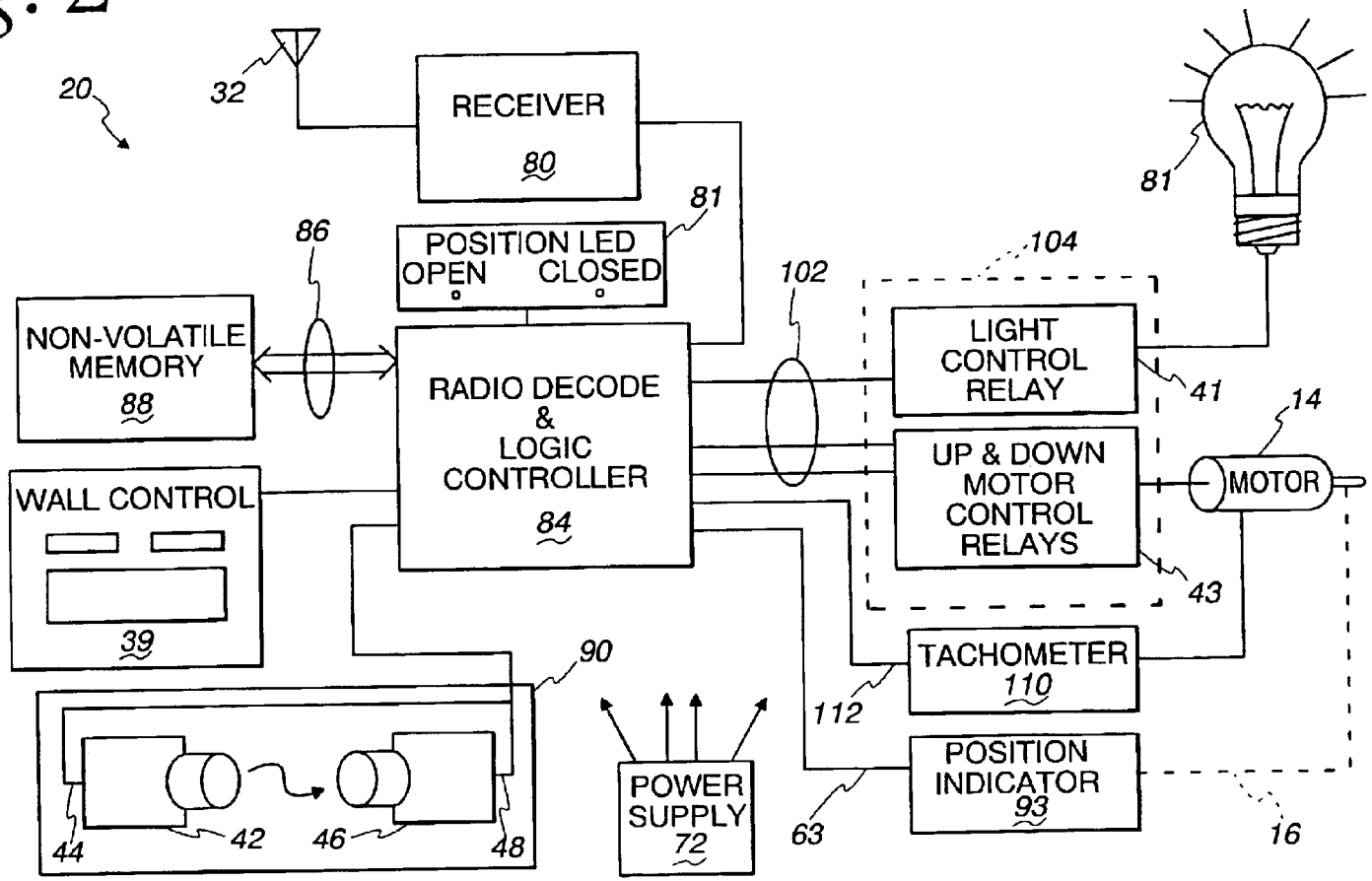
FIG. 2 is an electrical block diagram of a control system for the barrier movement apparatus.
Figure 3:
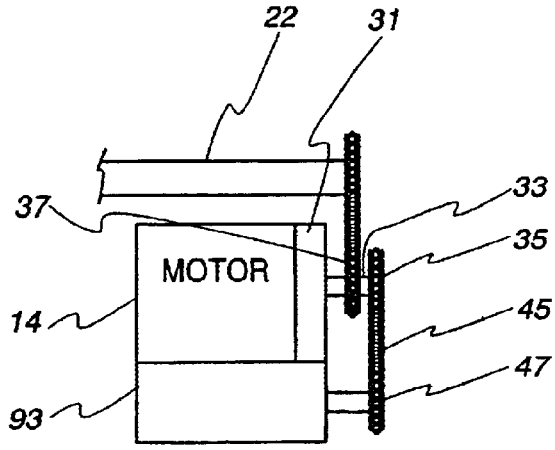
FIG. 3 represents the mechanical transmission between a motor jack shaft and position sensor.

The embodiment of FIG. 2 also includes a position indicator 93 which is coupled to motor 14 and sends signals representing door position to controller 84. FIG. 3 represents an embodiment of the coupling of position indicator 93 and motor 14. In FIG. 3 motor 14 rotates a shaft 33 via a gear reduction apparatus 31. Shaft 33 carries two sprockets 35 and 37. Sprocket 37 is coupled by a chain to jack shaft 22 for door movement. Sprocket 35 is coupled by a chain 45 to a sprocket 47 which drives a rotating shaft 49 to provide proportional motion at the position indicator 93. In the present embodiment, position indicator 93 includes a potentiometer 51 which changes angular position in response to the rotation of shaft 49 (see FIG. 9). A resistance value of potentiometer 51 changes as the angular position of shaft 49 changes and is used as discussed below to indicate the door position.

Figure 8:
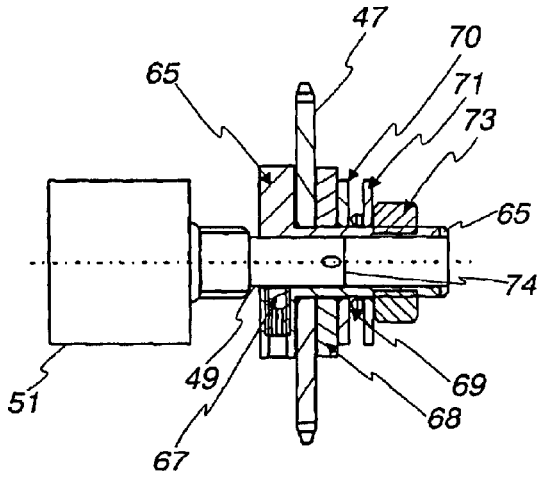
FIGS. 8 and 9 represent the mechanical structure of a pulley driven position sensor.
Figure 9:
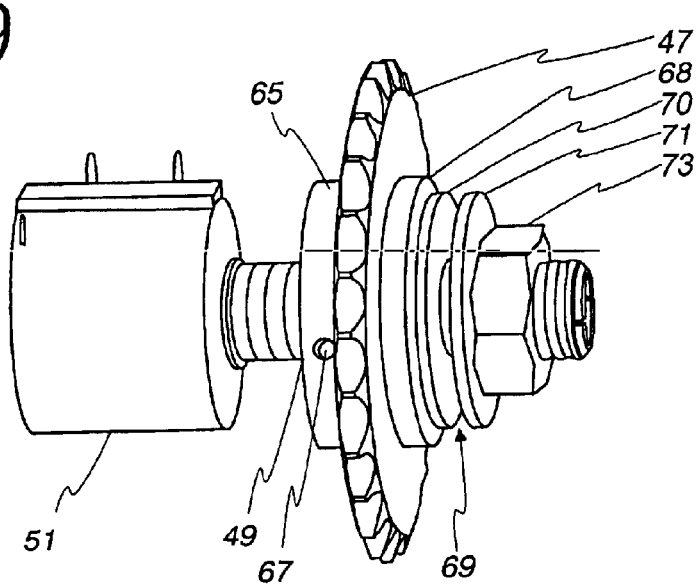

FIGS. 8 and 9 show the physical structure of the potentiometer 51 and related driving apparatus. As the motor 14 rotates the sprocket 47 rotates proportionally. The rotating shaft 49 of a potentiometer is frictionally connected to rotate with the sprocket 47. Because the body of potentiometer 51 is fixed to the frame of the barrier movement apparatus, the rotation of shaft 49 changes a resistance valve of potentiometer 51. The frictional connection between shaft 49 and sprocket 47 consists of a clutch hub 65 which is attached to the shaft 49 by means of one or more set screws 67. The sprocket 47 contacts the clutch hub 65 and is kept in place by a friction pad 68, a pressure plate 70, a wave spring 69, a pressure plate 71 and a hex nut 73 threaded onto the clutch hub. The hex nut 73 is tightened onto the clutch hub to maintain pressure against sprocket 47.

The frictional forces on sprocket 47 allow it to rotate the potentiometer shaft 49 until one of the two clockwise or counter-clockwise limits of the potentiometer is contacted. Then the sprocket will then slip in its frictional contact. In addition, shaft 49 has a slot 74 across one end so that a tool such as a screwdriver can be used to adjust the potentiometer resistance by rotating the shaft. When shaft 49 is rotated by a screwdriver, the clutch assembly slips with regard to the sprocket 47.

Figure 4:
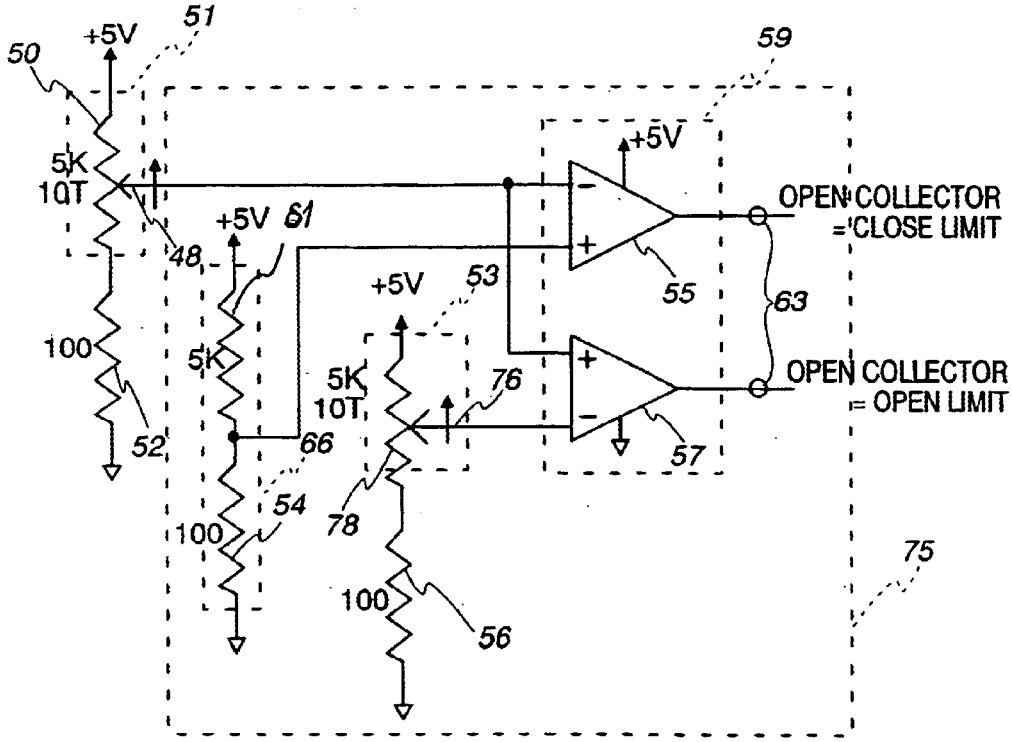
FIG. 4 is a schematic of an open and closed limit detector.
Figure 5:
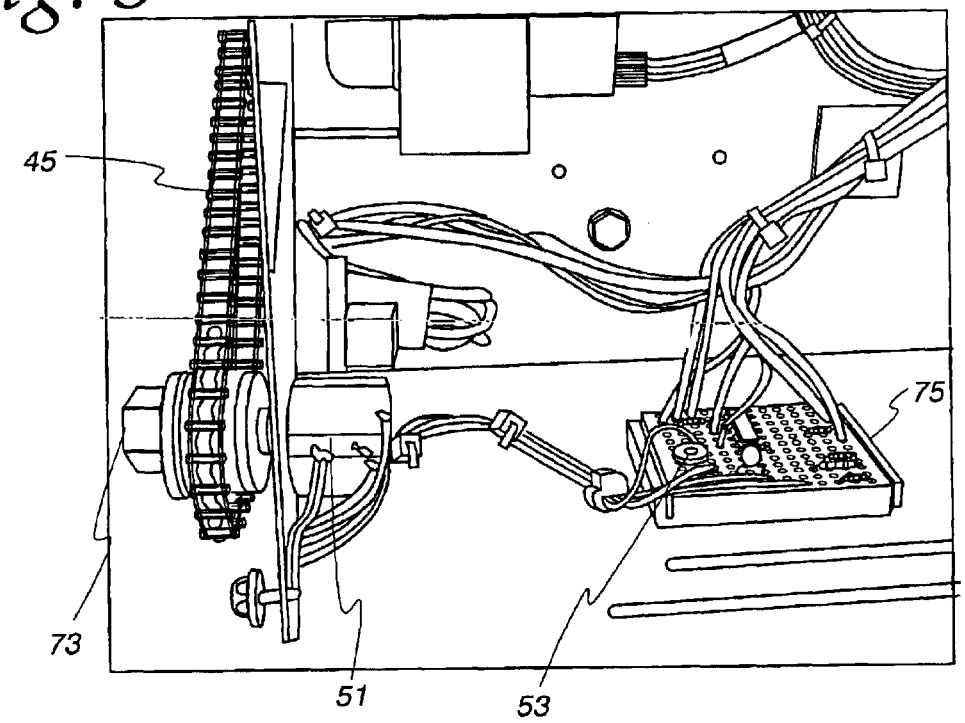
FIG. 5 is a perspective view of the mechanical and electrical connections between a potentiometer and additional door position sensing apparatus.
Figure 6:
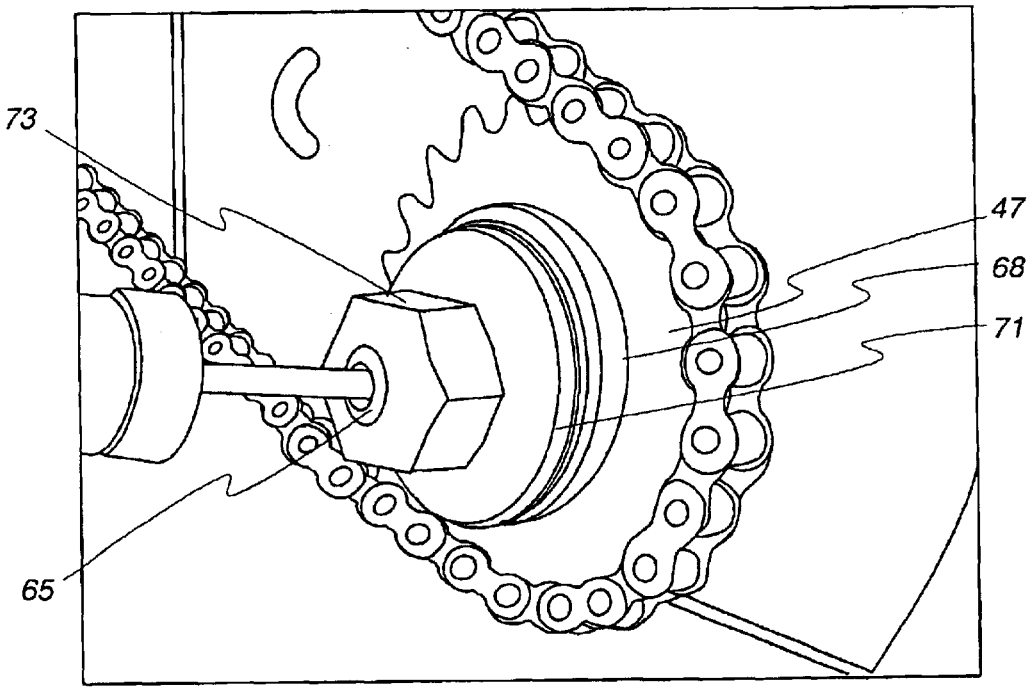
FIG. 6 represents manual adjustment of a position sensing potentiometer.
Figure 7:
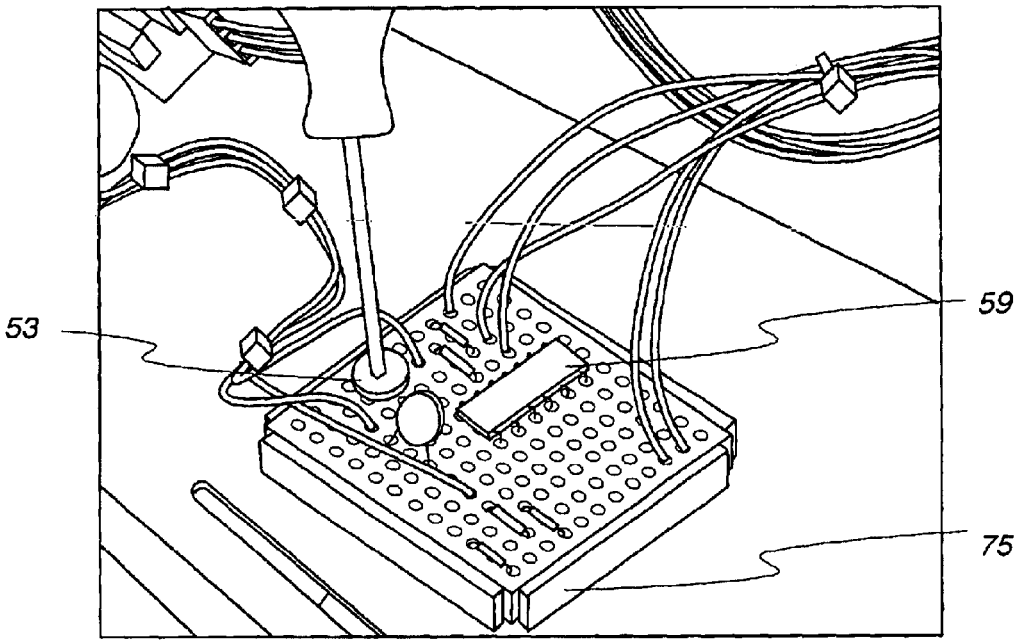
FIG. 7 is a perspective view of manual adjustment of a reference signal.

FIG. 4 represents an electrical circuit for use with potentiometer 51 to perform as position indicator 93 in FIG. 2. In the embodiment of FIG. 4 two comparators 55 and 57 are used to generate signals indicating the barrier position to be that of closed or that of open. The signals from comparators 55 and 57 are conveyed to controller 84 via a communication path 63. A predetermined voltage is connected to one end of the resistor portion 50 of potentiometer 51 while the other end is connected via a resistor 52 to electrical ground. In the present embodiment, the resistor portion 50 is 5KΩ and resistor 52 is 100 Ω. The lower terminal of resistor portion 50 may be connected directly to ground however, in some embodiments a small resistor such as 52 is used to assure that logic input do not fall below 0 volts. The wiper 48 of a potentiometer is connected to the negative (−) input of comparator 55. Thus, as the wiper position on resistor 50 is adjusted, a variable voltage is applied as the negative input to comparator 55. The positive (+) input of comparator 55 is connected to a voltage reference 66 derived from the serial connection of resistors 61 and 54 between the predetermined voltage and ground. In the present embodiment resistor 61 is substantially equal to the value of resistor 50 and the resistance value of resistor 54 is substantially equal to the resistance of resistor 56.

As the barrier is moved, shaft 49 (FIG. 9) is rotated which changes the position of wiper 48 on resistor 50 causing a change of the voltage applied to the negative input of comparator 55. As long as the voltage from wiper 48 remains greater than the reference 66 voltage received by comparator 55 from resistors 54 and 61 a first signal is sent to controller 84. When the two input voltages to comparator are equal, a second signal is sent to controller 84 which interprets the second signal as a door-closed signal.

During a set up procedure, during door assembly, the motor 14 is activated to move the door to the closed position. This will cause wiper to move to one of the two rotation limits of potentiometer 51, if such is within the range of door motion. In order to make certain that a limit position has been reached after the door is in the closed position, a screwdriver is inserted into slot 74 and is used to apply rotational force to shaft 49 to move the wiper to its least resistance limit position. If it is already there, no movement will occur. If it is not at the lowest limit, the operator with the screwdriver will manually rotate the shaft until the lowest limit position is achieved. Such will be signaled by the controller 84 which lights a LED on a panel such as 81 (FIG. 2) when the second signal is generated by comparator 55. After the manual adjustment of potentiometer 51 comparator 55 will generate the second signal indicating that the closed limit has been reached when the door is closed and generates the first signal when the door is in other positions.

The voltage signal from the wiper 48 of potentiometer 51 is also applied to the positive (+) input of a comparator 57. The negative (−) input of comparator 57 is connected to the wiper 76 of a second potentiometer 53. The resistance 78 of the potentiometer 53 is connected between the predetermined voltage and ground via a resistor 56. Thus, the negative input of comparator 57 receives a reference voltage from potentiometer 53. As with comparator 55, comparator 57 generates a first output signal when the negative input exceeds the positive input and it generates a second signal when the two inputs are equal. During system set up, after the potentiometer 53 is manually adjusted to represent the closed limit, the door is moved to the open position, increasing the voltage on wiper 48. When in the open position, potentiometer 53 is adjusted so that the voltage applied to comparator from potentiometers 51 and 53 are equal. Thus, causing comparator 57 to generate the second signal when the door reaches the open position.

Controller 84, which receives the output of comparator 57, responds to a transition from the first signal to the second signal by stopping the motor, when running, and lights an open LED81. After potentiometers 51 and 53 are adjusted as described above, the controller can easily identify open and closed limit positions by responding to changes in state of the comparators 55 and 57 outputs.

In the preceding embodiments two comparators are used to establish an open limit and a closed limit signal. Additional comparators may be employed in the same manner as comparator to allow the identification of one or more positions intermediate to the open limit and closed limit. Thus, each of the "intermediate" comparators would receive the voltage from wiper 48 as one input and the voltage of an adjustable reference similar to that provided by potentiometer 53 as the other input. During set up, the barrier would be stopped at an intermediate position and the equivalent of potentiometer 53 in the "intermediate" reference would be adjusted until equal to the voltage of wiper 58. Thereafter, the controller will recognize the intermediate position because of the signal state change by the "intermediate" comparator.

Figure 10:
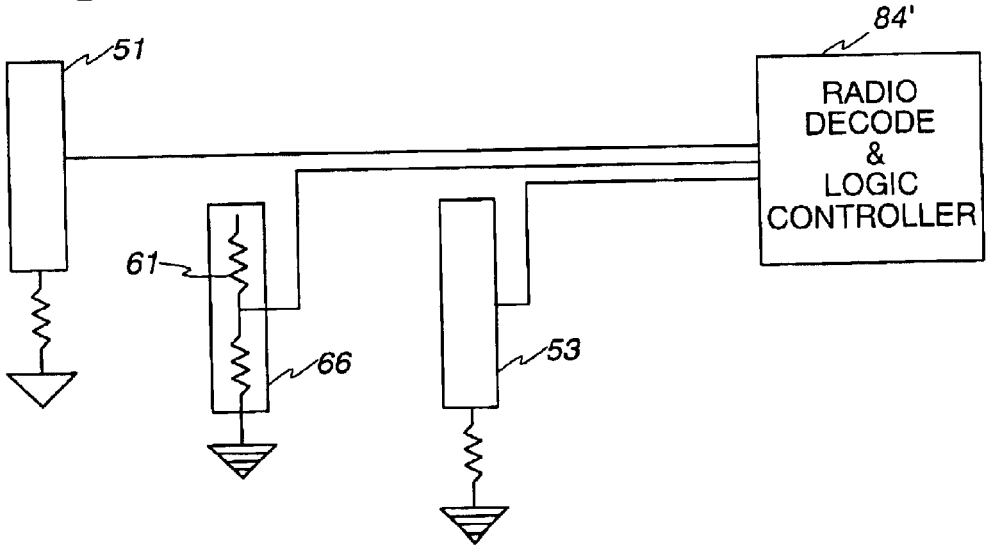
FIG. 10 is a block diagram of an embodiment of portions of the door position sensor.

The preceding embodiments use physical comparators mounted on a circuit board 75 to generate state change signals. Any arrangement for detecting the equality of voltage may be employed to identify learned positions. For example, a controller 84' (FIG. 10), which functions much the same as controller 84 of FIG. 2, may include analog comparators for detecting the voltage levels of barrier positions and references. Alternatively, controller 84' may convert voltage inputs to digital and perform digital comparisons to identify voltage equality. For example, the barrier could first be stopped at any position and controller 84', upon activation of a learn push button 87, would detect the voltage from potentiometer 51 and reference 66. The relative difference could then be used to identify subsequent occurrences of other barrier positions relative to the voltage from potentiometer 51.

What is claimed is:

1. Apparatus for indicating positions of a movable barrier comprising:

barrier movement apparatus;

a first potentiometer, connected to the barrier movement apparatus to change a first electrical resistance of the first potentiometer in response to barrier movement;

adjustment apparatus permitting manual setting of the first electrical resistance value of the first potentiometer to a predetermined first value when the barrier is in a first position; and position indicating circuitry responsive to the first electrical resistance value of the first potentiometer for indicating the position of the barrier.

2. The apparatus of claim 1 wherein the position indicating circuitry comprises a comparator.

3. The apparatus of claim 2 wherein the position indicating circuitry comprises a second adjustable reference value representing a second position of the barrier.

4. The apparatus of claim 3 wherein the second adjustable reference value comprises a reference voltage divider circuit including a second potentiometer.

5. The apparatus of claim 4 comprising an input voltage divider circuit including the first resistance value and wherein the comparator is connected to receive as inputs a voltage value from the input voltage divider circuit and the second reference value.

6. The apparatus of claim 1 wherein the position indicating apparatus comprises a plurality of manually adjustable reference values, each reference value representing a different barrier position.

7. A barrier movement apparatus comprising, a motor connected to a barrier for moving the barrier;

a controller for generating signals to control barrier position by controlling the motor;

a first potentiometer connected to the barrier movement apparatus to change a first electrical resistance of the first potentiometer in response to barrier movement;

adjustment apparatus permitting manual setting of the resistance value of the first electrical resistance to a first value when the barrier is in a first position; and position indicating circuitry responsive to the resistance value of the first electrical resistance for indicating the position of the barrier.

8. The barrier movement apparatus of claim 7 comprising a source of electrical power and the controller responds to the barrier position indicated by the position indicating circuitry by controlling the application of electrical power to the motor.

9. The barrier movement apparatus of claim 8 wherein the controller responds to the barrier position indicated by the position indicating circuitry by stopping and starting the motor.

10. The barrier movement apparatus of claim 7 wherein the position indicating circuitry comprises a comparator.

11. The barrier movement apparatus of claim 10 wherein the position indicating apparatus comprises an adjustable reference value representing a second position of the barrier.

12. The barrier movement apparatus of claim 11 wherein the adjustable reference value comprises a second potentiometer.

13. The barrier movement apparatus of claim 12 wherein the comparator is connected to receive as inputs a voltage value representing the first electrical resistance and the second reference value.

14. A method of adjusting limits for a barrier movement operator including a first potentiometer having a variable electrical resistance value representing a position of the door, the method comprising:

moving the barrier to a first position;

manually adjusting the first potentiometer to produce a predetermined value of resistance at the first position;

moving the barrier to a second position adjusting a second electrical resistance value at the second position; and generating a signal indicating the barrier to be in the second position by comparing the first resistance value and the second resistance value.

15. The method in accordance with claim 14 comprising:

moving the barrier to a third position adjusting a third electrical resistance at the third position; and generating a signal indicating the barrier to be in the third position by comparing the resistance values of the first and third electrical resistance.

16. A method in accordance with claim 14 wherein the barrier movement operator comprises a motor and a motor controller for controlling the position of the door, the method comprising:

moving the barrier toward the second position; and responding to the signal indicating the door to be in the second position by stopping movement of the barrier.

17. A method in accordance with claim 16 wherein the moving step comprises, moving the barrier from the first position to the second position.

18. A method in accordance with claim 16 comprising:

moving the barrier toward the third position; and responding to the signal indicating the barrier to be in the third position by stopping movement of the barrier.

19. Apparatus for indicating positions of a movable barrier comprising:

barrier movement apparatus;

a first potentiometer connected to the barrier movement apparatus to change an angular orientation of the first potentiometer in response to barrier movement;

adjustment apparatus permitting manual setting the orientation of the first potentiometer to a first value when the barrier is in a first position; and position indicating circuitry responsive to the first potentiometer for indicating the position of the barrier.

20. A barrier movement apparatus comprising, a motor connected to a barrier for moving the barrier;

a controller for generating signals to control barrier position by controlling the motor;

a first potentiometer connected to the barrier movement apparatus to change the angular orientation of the first potentiometer in response to barrier movement;

adjustment apparatus permitting manual setting of the angular orientation of the first potentiometer to a first value when the barrier is in a first position; and position indicating circuitry responsive to the angular orientation of the first potentiometer for indicating the position of the barrier.

21. A position indicating assembly for a barrier movement assembly to allow a position of the barrier to be determined, the position indicating assembly comprising:

a motor for driving the barrier for movement;

an adjustable sensor for indicating a value based on door position;

a drive transmission between the motor and the barrier for moving the door with operation of the motor; and an adjustment member frictionally coupled to the sensor to change the indicated value as the barrier moves and to allow the sensor to be manually adjusted to indicate a predetermined value with the motor inoperative and the barrier at a predetermined position for setting of the same.

22. The position indicating assembly of claim 21 wherein the adjustment member is a rotary shaft, and the transmission portion includes a gear, and a friction clutch assembly including a bearing portion fixed to the shaft for rotation therewith and a pressure portion for frictionally clamping the gear to the bearing portion with a predetermined amount of frictional force for rotation with the shaft and so that the gear and shaft can rotate relative to each other with a force manually applied therebetween that is greater than the frictional coupling force.

* * * * *